US007128660B2

(12) United States Patent
Gillig

(10) Patent No.: US 7,128,660 B2
(45) Date of Patent: Oct. 31, 2006

(54) METHOD OF GOLF CLUB PERFORMANCE ENHANCEMENT AND ARTICLES RESULTANT THEREFROM

(75) Inventor: John P. Gillig, Pompano Beach, FL (US)

(73) Assignee: Elizabeth P. Gillig Revocable Trust, Duxbury, MA (US)

( * ) Notice: Subject to any disclaimer, the term of this patent is extended or adjusted under 35 U.S.C. 154(b) by 0 days.

(21) Appl. No.: 10/818,899

(22) Filed: Apr. 3, 2004

(65) Prior Publication Data

US 2004/0192466 A1 Sep. 30, 2004

Related U.S. Application Data

(63) Continuation-in-part of application No. 10/383,532, filed on Mar. 10, 2003, now abandoned, which is a continuation-in-part of application No. 09/849,522, filed on May 7, 2001, now Pat. No. 6,530,848.

(60) Provisional application No. 60/205,250, filed on May 19, 2000.

(51) Int. Cl.
*A63B 53/00* (2006.01)
*A63B 53/04* (2006.01)

(52) U.S. Cl. ..... 473/324; 473/409; 473/334; 473/340; 473/345

(58) Field of Classification Search ..... 473/324–350, 473/290–291, 409
See application file for complete search history.

(56) References Cited

U.S. PATENT DOCUMENTS 3,841,640 A 10/1974 Gaulocher
4,431,192 A * 2/1984 Stuff, Jr. ..... 473/327
D291,465 S * 8/1987 Antonious ..... D21/744
4,826,172 A 5/1989 Antonious
4,900,029 A 2/1990 Sinclair
5,014,993 A * 5/1991 Antonious ..... 473/350
5,058,895 A 10/1991 Igarashi
5,297,794 A 3/1994 Lu
5,683,307 A 11/1997 Rife
5,916,042 A 6/1999 Reimers
5,947,840 A 9/1999 Ryan
D427,263 S 6/2000 Bober
6,077,173 A * 6/2000 Stites ..... 473/334
6,280,348 B1 8/2001 Stites
6,309,311 B1 * 10/2001 Lu ..... 473/332
6,530,848 B1 3/2003 Gillig (Continued)

FOREIGN PATENT DOCUMENTS

JP 2000-005356 1/2000

(Continued)

OTHER PUBLICATIONS

Art Chou, Peter Gilbert, and Tom Olsavsky, Clubhead Designs: How to They Affect Ball Flight, Tideist and Foot-Joy Worldwide, USA, 1995, pp. 15-24, n/a, Tideist and Foot Joy Worldwide, USA.

*Primary Examiner*—Sebastiano Passaniti
(74) *Attorney, Agent, or Firm*—Melvin K. Silverman; Yi Li

(57) ABSTRACT

The performance of a golf club may be enhanced through the provision of a void space behind a face plate and above the sole plate, to decrease club weight and provide single or combinations of selectable weighting elements within volumetric coordinates of an orthonormal matrix about the void space. The weighting coordinates are provided in response to ball strike, flight analysis and physiologic observation of the golf strike swing. Ball backspin, trajectory, penetration and hook or slice may be modified through the use of a definable weighting strategy.

19 Claims, 11 Drawing Sheets

U.S. PATENT DOCUMENTS

| | | | |
|---|---|---|---|
| D487,491 | S | 3/2004 | Madore et al. |
| D487,492 | S | 3/2004 | Madore et al. |
| D487,493 | S | 3/2004 | Madore et al. |
| D488,203 | S | 4/2004 | Madore et al. |
| 2003/0199331 | A1 | 10/2003 | Stites, III |
| 2004/0018890 | A1 | 1/2004 | Stites et al. |
| 2004/0110575 | A1 | 6/2004 | Stites et al. |
| 2005/0009625 | A1 | 1/2005 | Stiles et al. |
| 2005/0137024 | A1 | 6/2005 | Stiles et al. |

FOREIGN PATENT DOCUMENTS

| | | |
|---|---|---|
| JP | 2000-210400 | 8/2000 |
| JP | 2001-079124 | 3/2001 |

* cited by examiner

METHOD OF GOLF CLUB PERFORMANCE ENHANCEMENT AND ARTICLES RESULTANT THEREFROM

REFERENCE TO RELATED APPLICATIONS

This is a continuation-in-part of application Ser. No. 10/383,532, entitled Multi-purpose Golf Club, filed Mar. 10, 2003, now abandoned and the same is incorporated herein by reference, which is a continuation-in-part of application Ser. No. 09/849,522, now U.S. Pat. No. 6,530,848, which is a utility conversion of Provisional Patent application No. 60/205/250, filed May 19, 2000. Each of said applications are incorporated by reference herein.

BACKGROUND OF THE INVENTION

A. Area of Invention

The invention relates to a method of selectably varying the center of gravity and distribution of weighting in a void space in the head of a golf club.

B. Prior Art

Golfing enthusiasts appreciate the dynamic characteristics of golf irons and woods and the manner in which performance of the same will vary as a consequence of physiologic characteristics of a particular golfer. Such physiologic factors will affect a variety of ball strike parameters including, without limitation, loft trajectory, inertial spin, range hook and slice.

My issued U.S. Pat. No. 6,530,848 (2003) sets forth the use of weighting options for the center of gravity ("CG") of a club resultant from a substantial hollowing out of or void space in a top or predominant portion of the club head, as a manufacturing step. Said void space teaches the significance of placement of the position of a weight within such hollowed-out portion to effect a variety of ball strike and flight characteristics including increase or decrease of clockwise spin, counterclockwise spin and back spin of the ball so propelled by the golf club. Said patent further sets forth the variability of a weight element to adjust the weight of the golf club to induce a more desirable ball spin to thereby accomplish an improved trajectory of ball flight.

Use of a cavity within the upper surface of a putter type golf club in to vary the weight or balance of the heel, toe and bottom portions of a putter club head, and certain uses of weights therein, is recognized in U.S. Pat. No. 5,683,307 (1997) to Rife, entitled Putter Type Golf Club Head with Balance Weight Configuration and Complementary Ball Striking Face. U.S. Pat. No. 3,841,640 (1974) to Gaulocher, entitled Golf Putter, reflects a rudimentary recognition of the importance of proper weighting within the head of a golf putter to compensate for physiologic needs and preferences of a golfer. Such approaches in the prior art have attempted to address one or another problem associated with the golf strike characteristics or, in some cases, the characteristics of the golf range surface. As is well known, golfing greens are replete with imperfections which affect ball speed, spin and roll. Accordingly, a wide range of both ball flight and ground surface performance factors can be attributed to weight distribution and position of the CG within the club head.

U.S. Pat. No. 4,909,029 (1990) to Sinclair employs an upper void space to modify the aerodynamics of the head of the golf ball.

The present inventive method reflects my discovery that many more options for positioning of the CG and distribution of weight or weights within the head of a golf club, whether that club comprises an iron, a wood, or a hybrid thereof, in positioning, behind the club face, selectable high density weighting elements at coordinates of an orthonormal matrix up to 27 potential locations in a void space, to thus compensate for physiologic imperfections in one or more characteristic of the swing of a golfer. The angulation and curvature of the club face relative to said matrix provides a yet further performance enhancing parameter that co-acts with weight elements within said matrix.

Published U.S. Specification US 2003/0199331A1 teaches use of a re-positionable weight chip in a golf club to modify club performance.

SUMMARY OF THE INVENTION

The performance of golf club heads made of wood, plastic, metal, and composites thereof may be enhanced through the provision of a void space behind a face plate and above the sole portion, to decrease club weight and provide single or combinations of selectable weighting elements within volumetric coordinates of an orthonormal matrix within said void space. Said coordinates are provided as a function of ball strike, flight analysis and physiologic or computerized observation of the golf strike swing. In a basic embodiment, ball flight may be affected by varying the mass of a selectable sole portion which may be uniformly or variably weighted from the club hosel to toe end. Weight of uniform or non-uniform distribution may also selectably be provided within the void space behind the face plate and above the fixed sole portion. The angle and curvature of the face plate may also be varied.

The inventive method more particularly comprises a method of golf club performance enhancement, the method comprising the steps of (a) provision of a void space behind a face plate of said club and above a sole portion thereof; and (b) in a virtual X, Y, Z orthonormal coordinate system in which said sole portion is partially congruent with a bottom-most xy plane thereof, in which said face plate intersects a forward-most XZ plane thereof, and in which a heel and hosel side of said club intersects a YZ plane thereof substantially at an origin of said coordinate system, and further in which an increase in X-axis value corresponds to a direction of a toe of said club, an increase in Y-axis value corresponds in direction to a rear of said club, and an increase in Z-axis value corresponds to increase in height above said sole portion, the steps of selectably employing at least two of the following club weighting strategies: (i) to modify backspin, providing within said void space, weighting means at a low Y, low Z coordinate to increase backspin or at a high Y, high Z coordinate to decrease backspin; (ii) to modify ball penetration, providing within said void space weighting means at a high Y, high Z coordinate to maximize penetration or at a low Y, low Z coordinate to minimize penetration; (iii) to modify ball trajectory, modifying weighting means within said void space at a low Z-coordinate to increase trajectory or at a high z-coordinate to decrease trajectory; and (iv) to compensate for bait hook or slice, providing weighting means within said void space at a low X-coordinate to compensate for hook or a high X-coordinate to compensate for slice.

It is accordingly an object of the invention to provide a golf club having a weight modifiable club head, inclusive of interchangeable sole plates and/or weighting elements, which express a universal method of golf club head modification to account for ball backspin, penetration, trajectory, and hook or slice.

It is another object to provide a wooden, plastic or metal golf club having a head with a hollowed out portion behind the face plate and above a uniform or non-uniform sole plate.

It is a further object of the invention to provide a golf club head with a hollowed-out void space, made during production, to a golfer's preference, and further providing a modifiable sole plate, with or without addition integral or added weights selectable positioned in volumetric coordinates of a virtual matrix about said void space.

It is a further object to provide a club head, modified with a hollow interior and having selectable point, axis, vector distributed linear or non-linear weights which may be inserted or removed to suit particular preferences, needs and physiologic requirements of a golfer.

It is a yet further object of the invention to provide improved elements and arrangements thru a method of providing an inexpensive, durable and effective means of compensating for ball spin, ball flight trajectory, ball spin and golf course surface variables.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
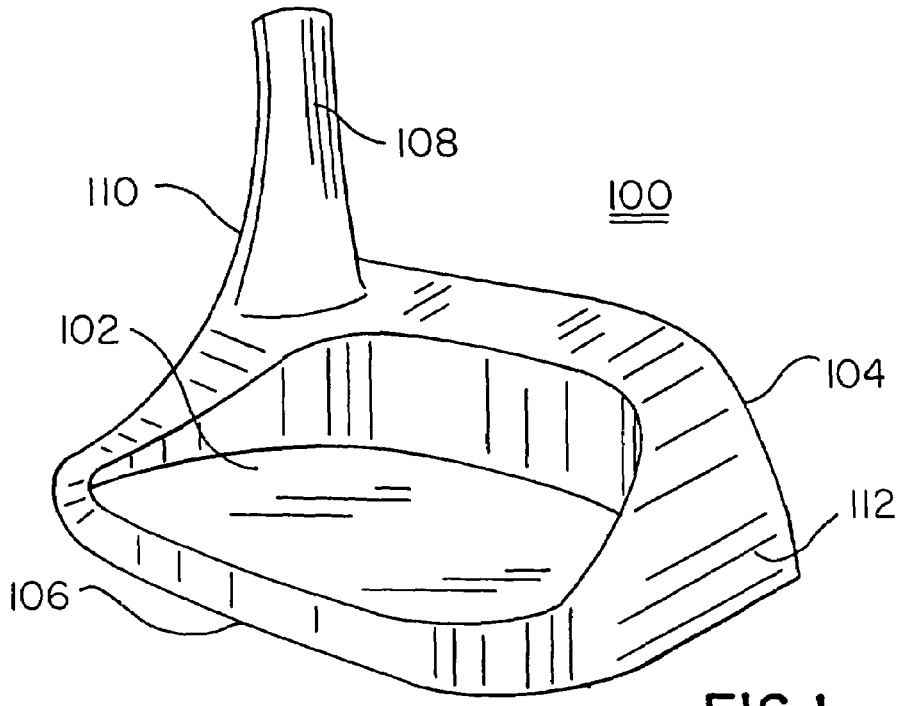
FIG. 1 is a perspective view of the head of a golf club configured for the practice of the present inventive method and products thereof.

With reference to the perspective view of FIG. 1, there is shown a golf club head 100 modified from the shape of more conventional golf club heads through the provision of a void space 102 behind a face plate 104 above a sole plate portion 106 of the club head 100. Also shown in FIG. 1 is a golf club hosel 108 which enters the club head at a heel 110 of the club. Located oppositely to heel 110 is club toe 112.

Figure 2:
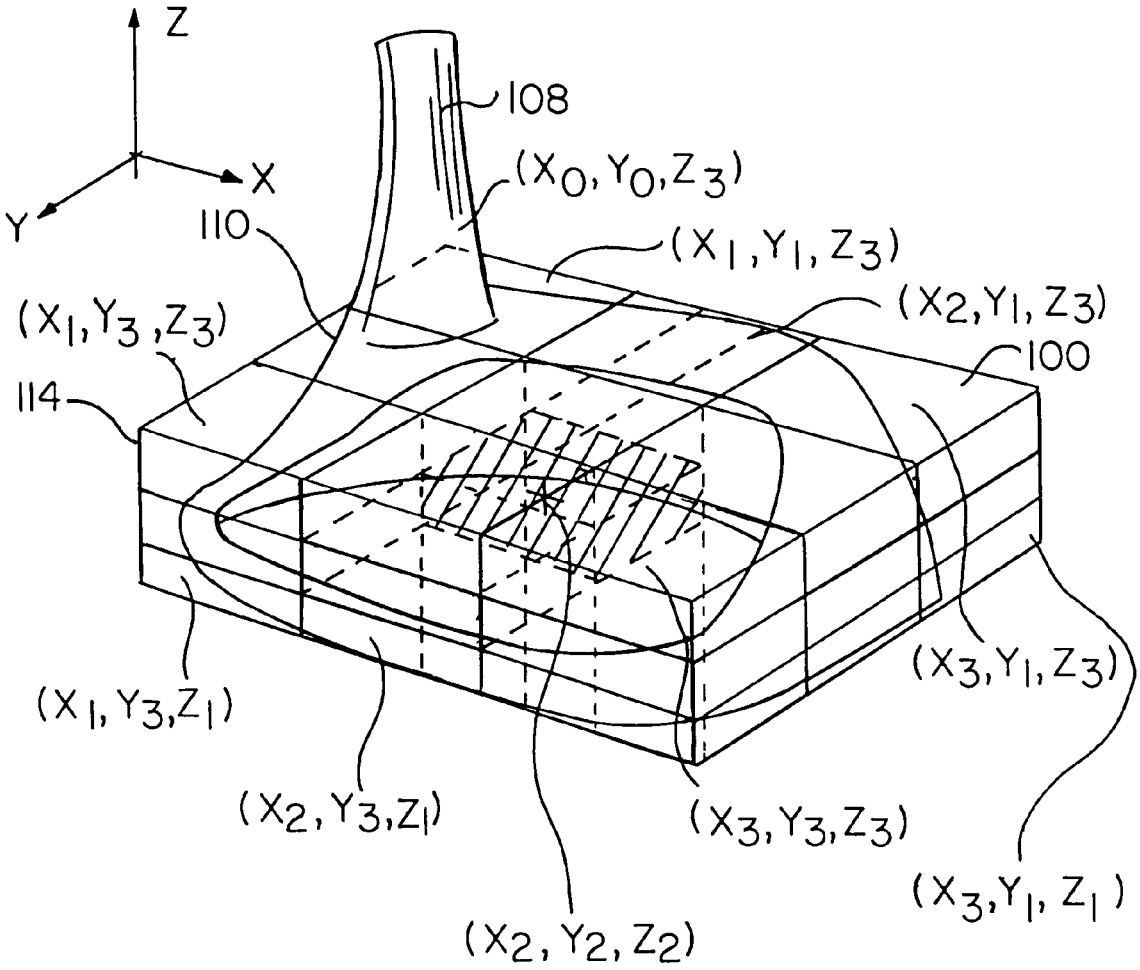
FIG. 2 is an illustration of a virtual three-dimensional orthonormal matrix by which the inventive method may be practiced.
Figure 3:
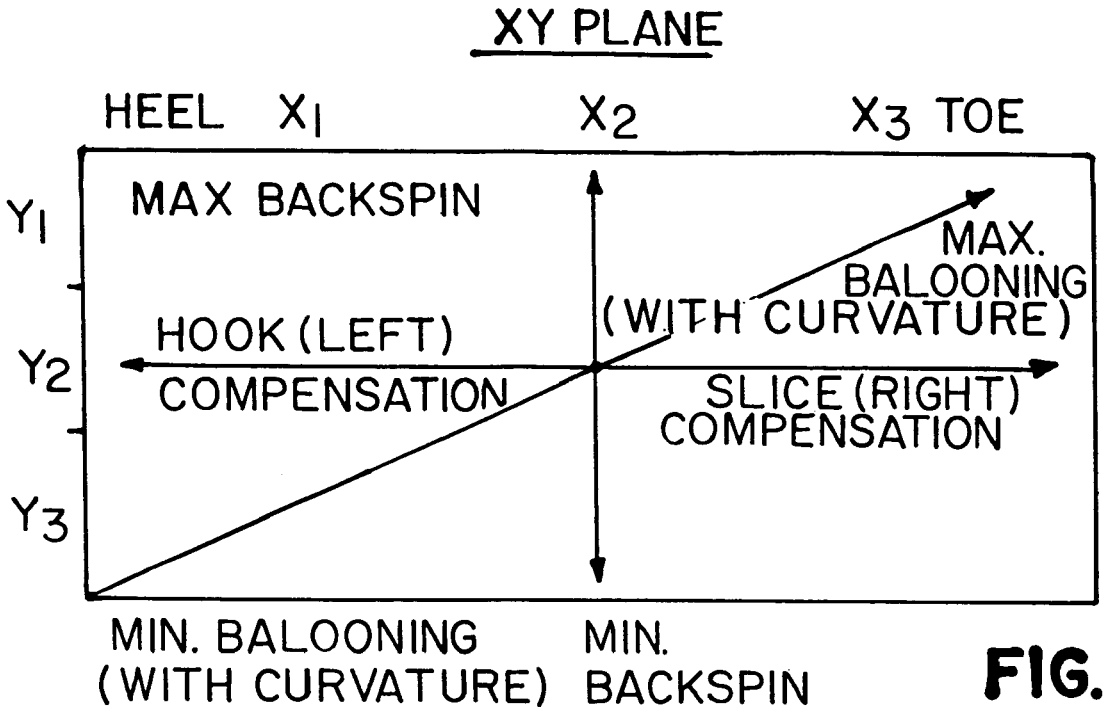
FIG. 3 is a graph-type illustration a golf club performance parameters which may be effected by weighting within the xy plane of said orthonormal matrix.
Figure 4:
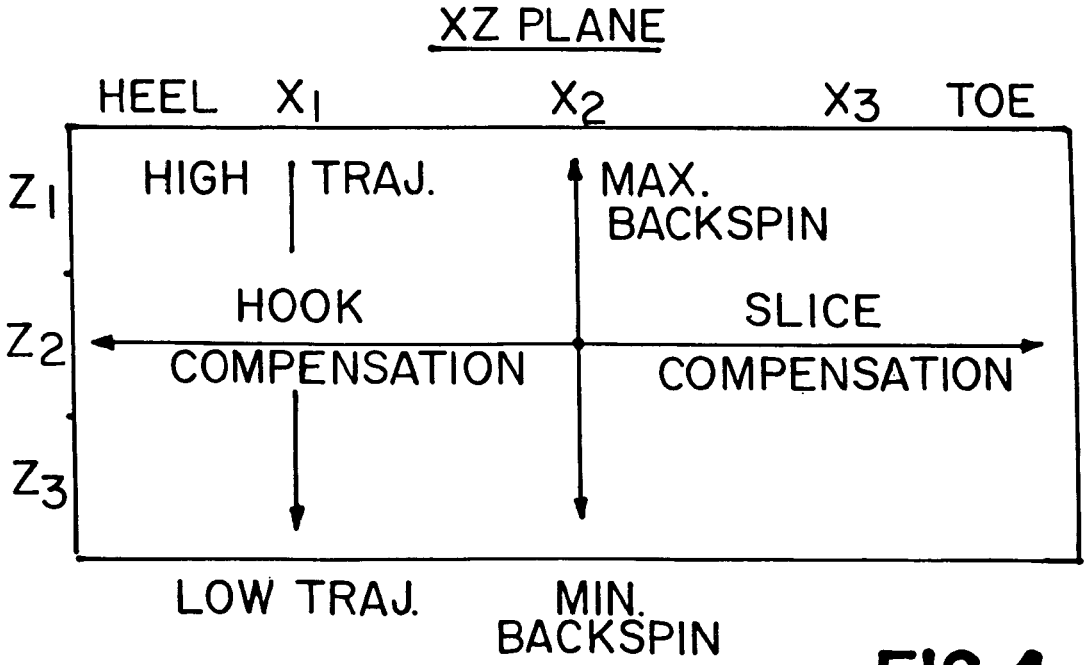
FIG. 4 is a graph showing the golf performance parameters which may be influenced by weighting within the xz plane of said matrix.
Figure 5:
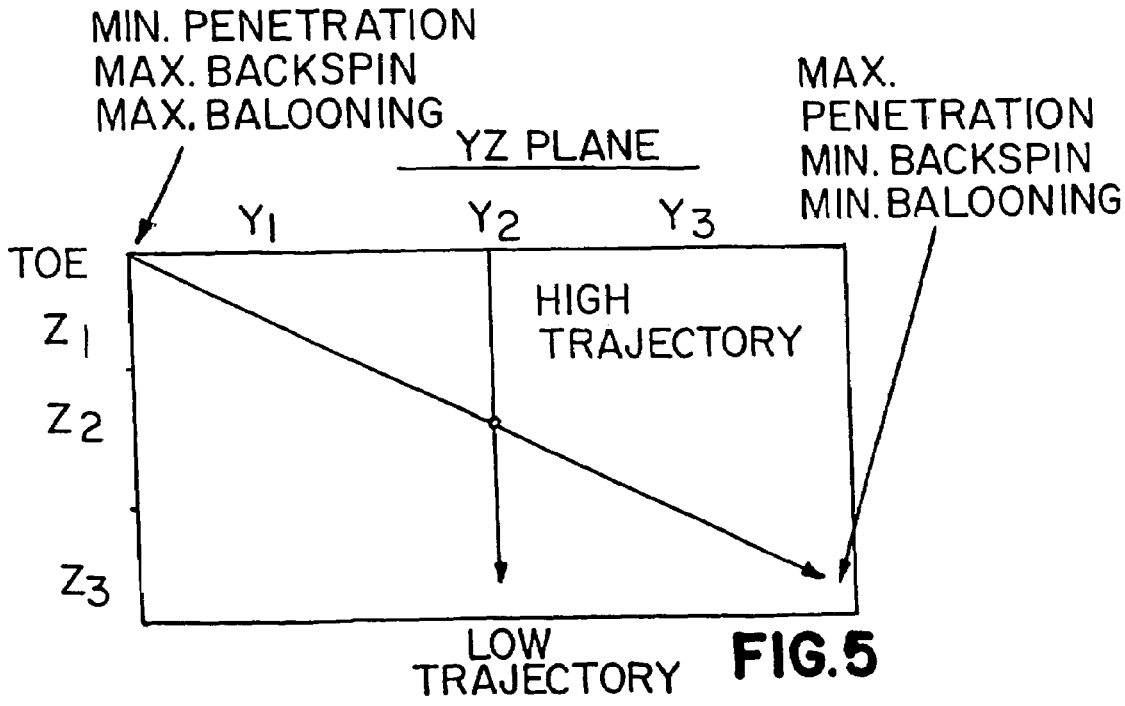
FIG. 5 is a graph showing the club performance characteristics which may be influenced by weighting within the yz plane of said matrix.

In FIG. 2 is shown an orthonormal matrix 114 which surrounds the club 100, and is defined by an X, Y and Z coordinate system corresponding to the three essential axes of the club, shown to the upper left of FIG. 2. Said X, Y and Z axes of said orthonormal matrix 114 provide far a 3×3×3 system of 27 volumetric coordinates. Therein, the position ($X_0$, $Y_0$, and Z3) defines the location it which hosel 108 enters dub head 100. The (X2, Y2, Z2) position, shown in shading In FIG. 2, represent the center of gravity of the club and is consistent with a normal or standard flight of the golf ball. In other words, a golfer having a perfect golf swing would, in accordance with the present system, apply a weighting element to a club head, of the type of club head 100, at position (X2, Y2, Z2) of the matrix shown therein. For ease of reference in the figures which follow, applicable coordinate nomenclature for various positions In the charts of FIGS. 3–5 are shown the XY, XZ and YZ coordinate relationships which affect particular parameters of ball strike, path, trajectory and rotation which are of interest to golfers. More particularly, shown in FIG. 3 is the effect of different types of weighting within the XY plane of orthonormal matrix 112, that is, the horizontal plane thereof. Therein, weighting in the +X or toe direction will increase the loft or ballooning of flight path of the golf ball, so that +X weighting direction of the club will provide for slice (right curvature) compensation of the golf ball. Conversely, weighting toward the heel or in the −X direction will provide for hook (left curvature) compensation. FIG. 3 also indicates that maximum backspin of the ball may be achieved by weighting at a low y position, that is, at the plane of the face plate, while minimum back spin may be accomplished through weighting toward the rear of the club, this corresponding to the Y3 position.

With reference to FIG. 4, one may note that hook or slice compensation, as in FIG. 3, remains a function of the weighting along the X-axis. In the XZ plane which is a vertical plane co-parallel with club hosel 108, trajectory may be controlled as a function of position of weighting upon the z-axis, that is, the lowest z-axis position (Z1) will afford the highest trajectory, whereas the highest z-axis position (Z3) will produce the lowest trajectory of ball flight.

Backspin of the ball is also a function weighting along the Z-axis. As may be noted by the line at the middle of FIG. 4, the Z1 position will produce a maximum spin of the ball, while weighting at Z3 will produce a minimum backspin. Accordingly, viewing FIGS. 3 and 4 in combination, it may be appreciated that a minimum backspin may be achieved by weighting at the (X2, Y3, Z3) coordinate, while maximum backspin may be achieved by weighting at the (X2, Y1, Z1) coordinate, as will also be illustrated in the figures which follow.

Figure 6:
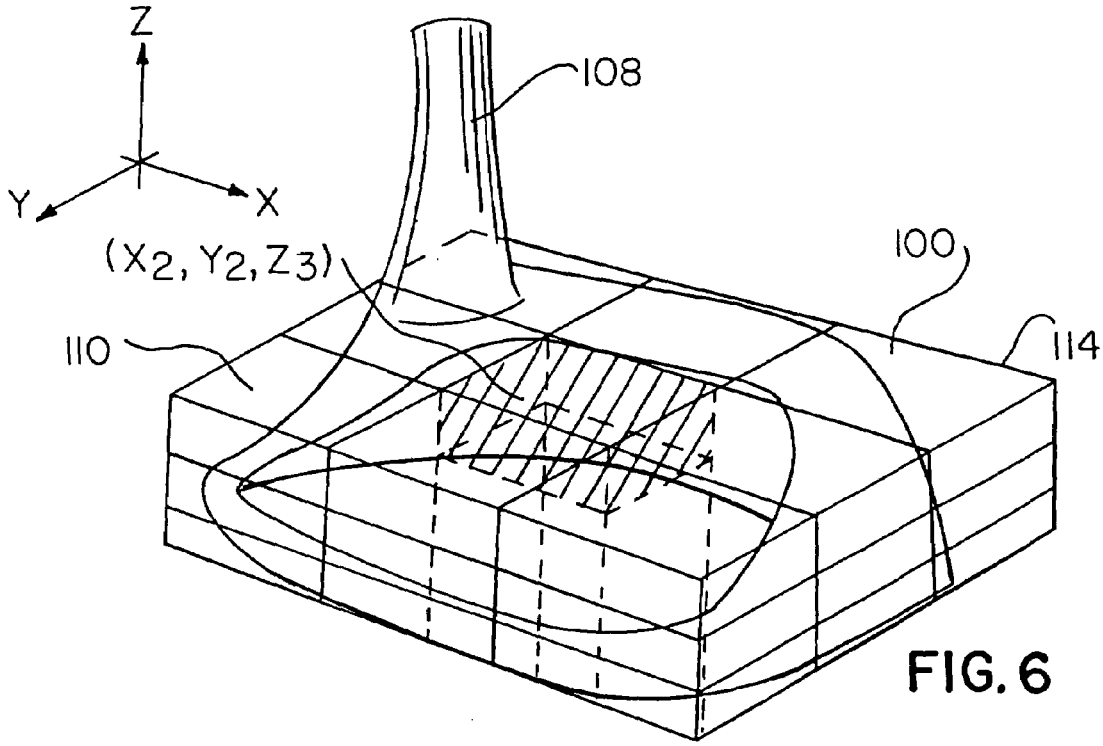
FIG. 6 is an illustration of a weighting of a club head of the type of FIG. 1 at a (X2, Y2, Z3) coordinate of said matrix.

With reference to FIG. 5, this chart corresponds to the YZ plane which is a vertical plane substantially parallel with toe face 110 of the club (see FIGS. 2 and 6).

From FIG. 5, it may be noted that minimum penetration, that is, maximum apex of ball flight, is achieved at the (Y1, Z1) position, while maximum penetration is achieved at the (Y3, Z3) position. Further, the highest trajectory may be seen to exist at the (Y2, Z1) position, while the lowest trajectory is achieved at the (Y2, Z3) position. Minimum backspin is achieved at (Y3, Z3) and maximum backspin at (Y1, Z1).

With the above in mind, the weighting coordinate (X2, Y2, Z3), which is shown in FIG. 6, should be appreciated as one that does not provide for either hook or slice compensation but which provides for reduced trajectory (flatter path of ball flight) and some decrease in backspin due to the Z3 part of the coordinate shown.

Figure 7:
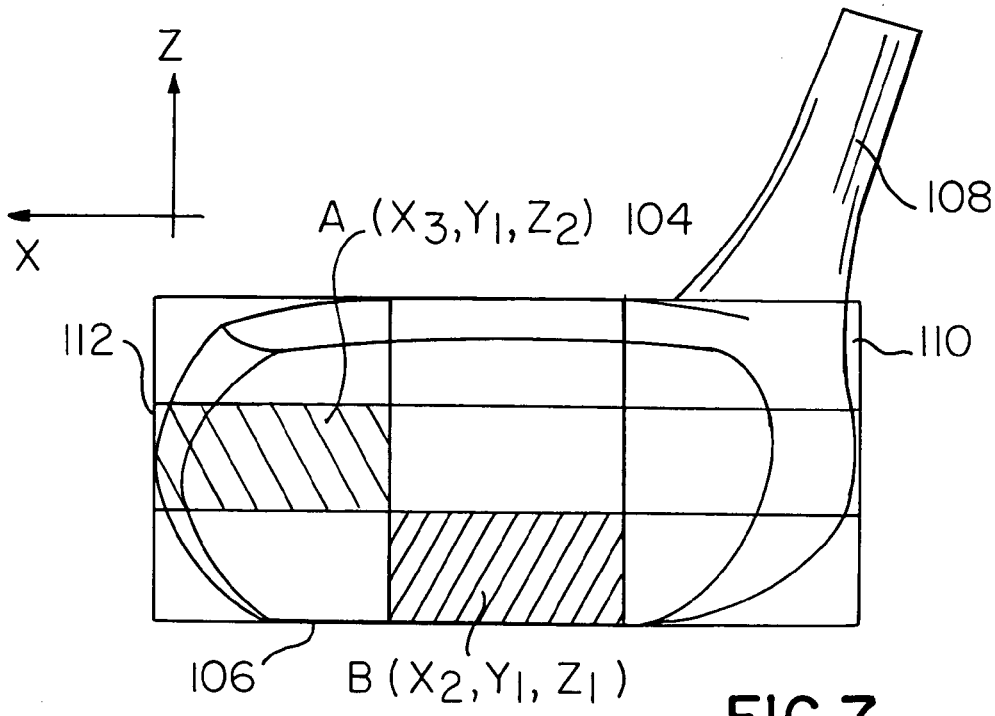
FIG. 7 is a front plan view of the club of FIG. 1 showing weighting at x3, Y1, Z2 coordinate and at a (X2, Y1, Z1) coordinate.

In FIG. 7 are shown two different weighting coordinates, both within the Y1 axis which includes the plane of face plate 104 of the club head. More particularly, a weighting element A shown to the left of FIG. 7 is the (X3, Y1, Z2) position and affords neutral ballooning, slice compensation, and some additional backspin. In distinction, weighting element B of coordinate (X2, Y1, Z1) provides for high trajectory, maximum backspin and minimum penetration.

Figure 8:
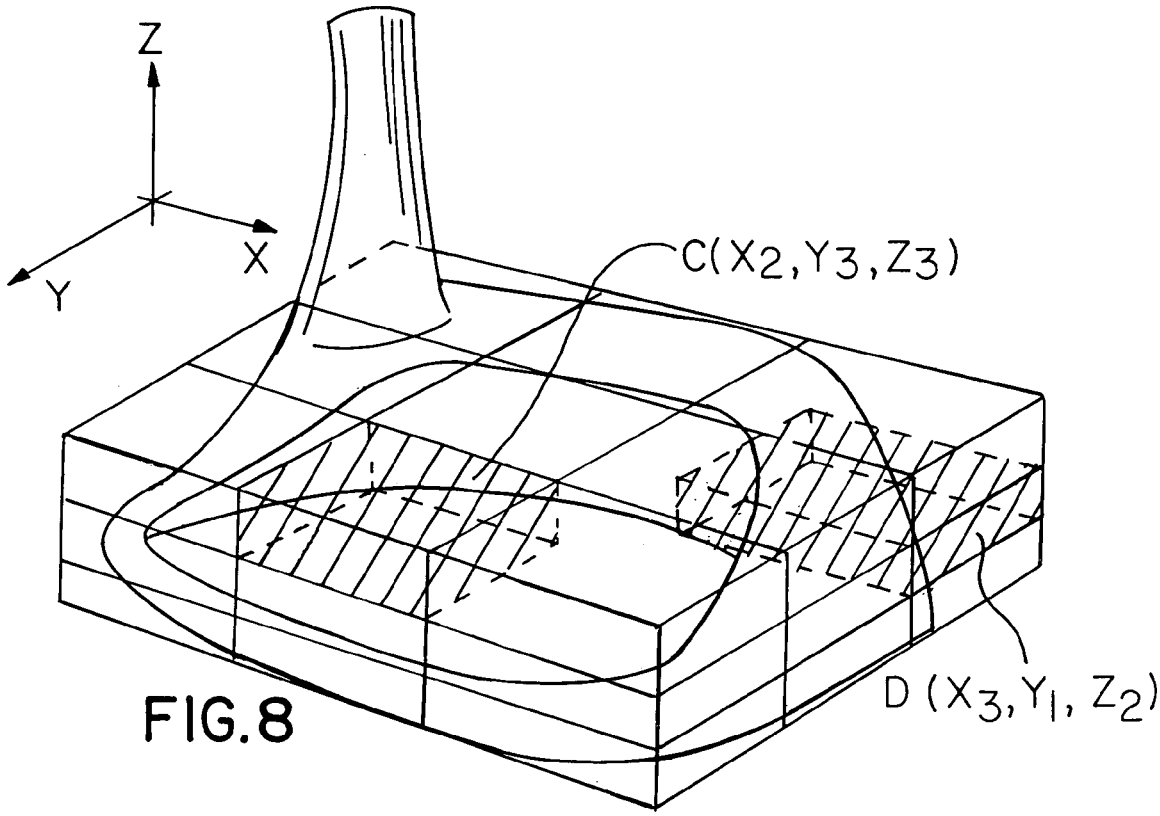
FIG. 8 is a view, similar to that of FIG. 6, however showing weighting of the club of FIG. 1 at a (X2, Y3, X3) coordinate and at the (X3, Y1, Z2) coordinate.

With reference to FIG. 8, weighting element C (coordinate X2, Y3, Z3) provides for low trajectory, minimum backspin and maximum penetration, while element D of FIG. 8 provides for neutral ballooning of ball flight, slice (right curvature) compensation and medium trajectory.

Figure 9:
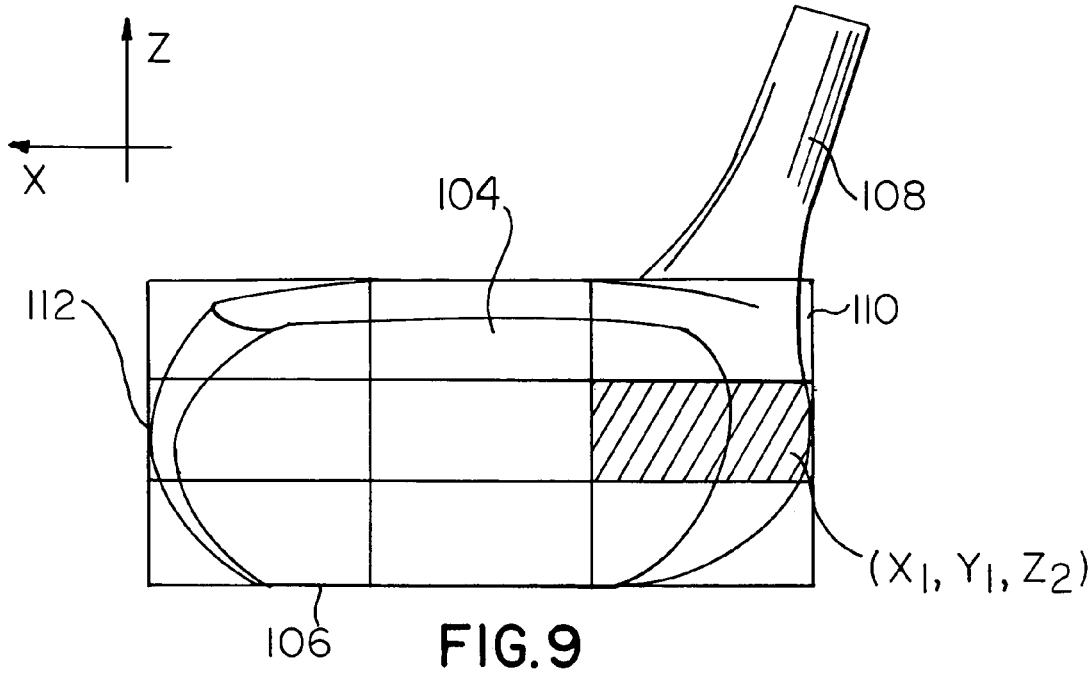
FIG. 9 is a view, similar to that of FIG. 7, however showing weighting at a (X1, Y1, Z1) coordinate.

With reference to the weighing element at (X1, Y1, Z2) shown in FIG. 9, such an arrangement will provide for neutral ballooning, hook compensation, slightly additional backspin and medium trajectory.

Figure 10:
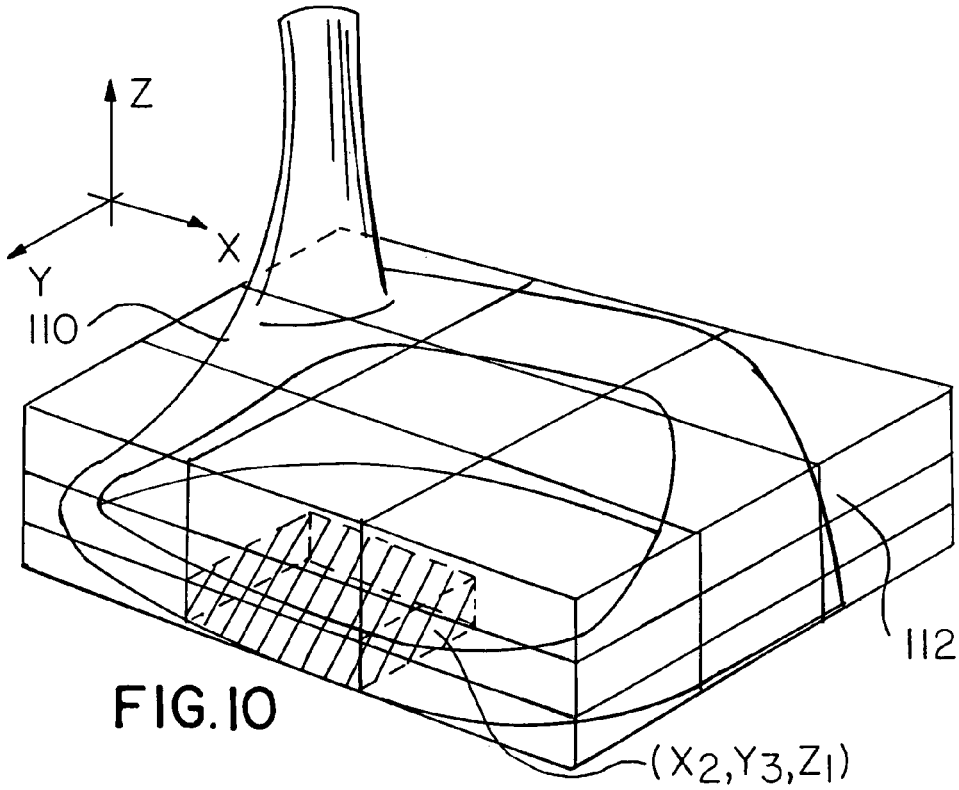
FIG. 10 is a view, similar to that of FIG. 6, however showing weighting at a (X2, Y3, Z1) position.

The weighting element (X2, Y3, Z1) shown in FIG. 10 affords high trajectory, high backspin and high penetration, although not as high penetration as would exist were the weighting at the (X2, Y3, Z3) position.

Figure 11:
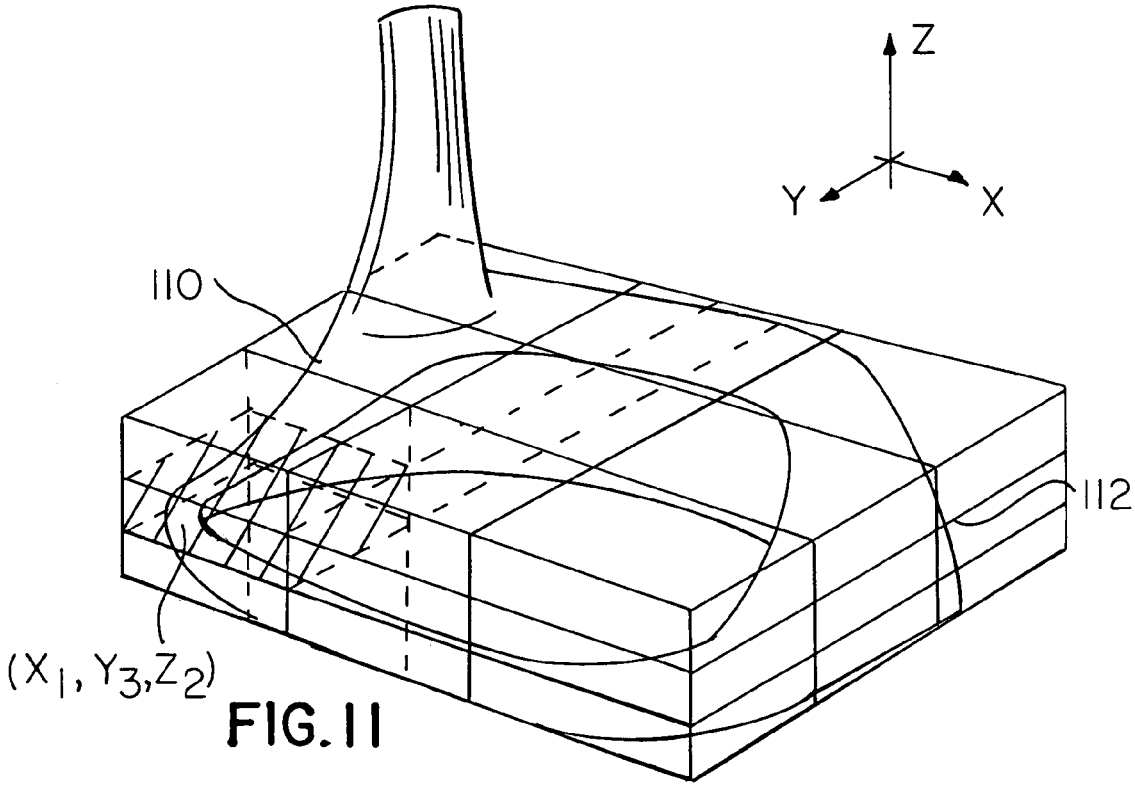
FIG. 11 is a view similar to that of FIG. 6, however showing weighting at a (X1, Y3, Z2) coordinate.

Shown in FIG. 11 is a weighting element at the (X2, Y3, Z2) position. Thereby, there is achieved hook compensation, high penetration and, no change in the ball's natural trajectory.

Figure 12:
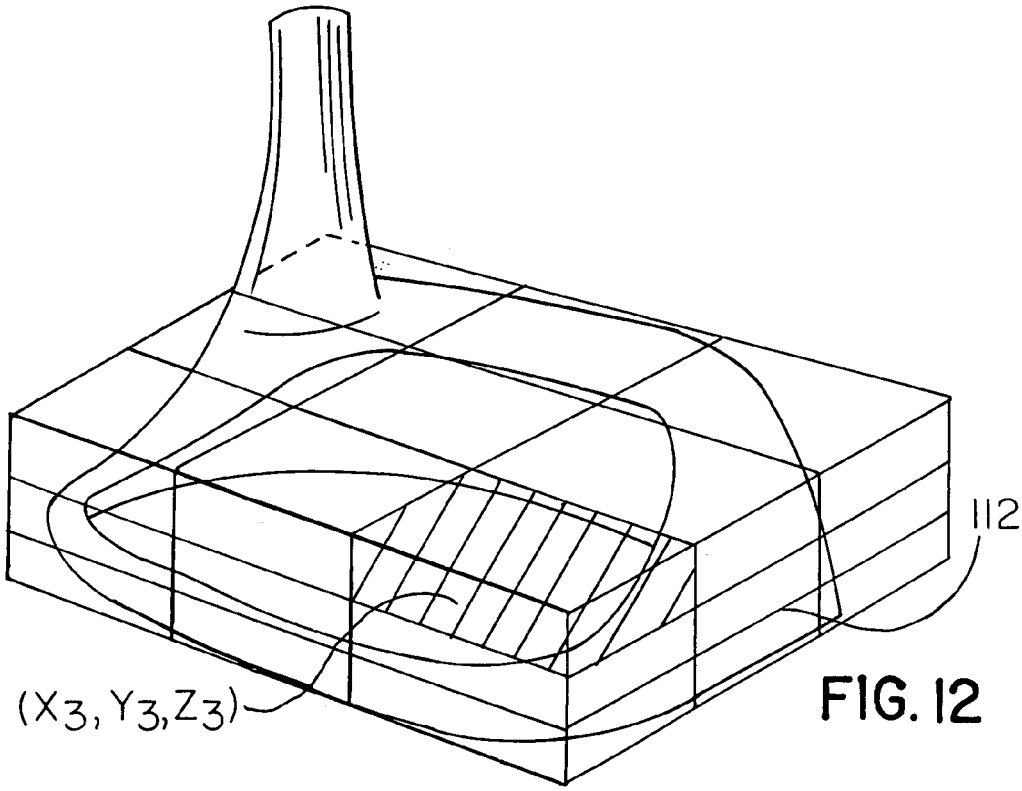
FIG. 12 is a view, similar to that of FIG. 6, however showing weighting of the club head at a (X3, Y3, Z3) coordinate of the orthonormal matrix.

In the weighting scheme shown in FIG. 12, that is, weighting at the (X3, Y3, Z3) coordinate position, one achieves slice compensation, decreased backspin, low trajectory and maximum penetration.

Figure 13:
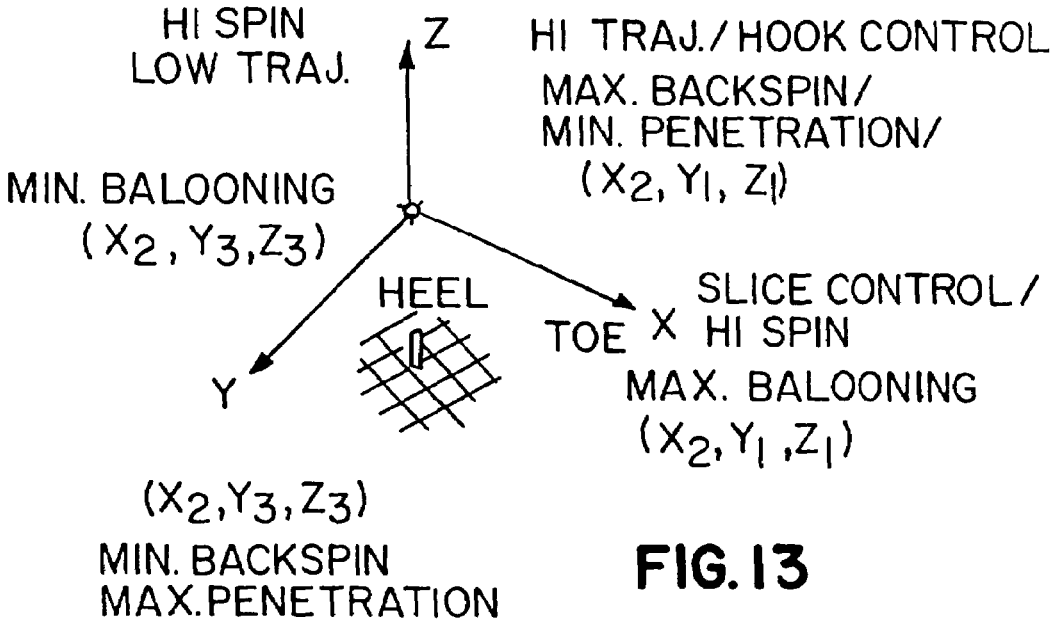
FIG. 13 is a three-dimensional graph showing the effect of weighting at different combinations of the X, Y, and Z coordinates of the orthonormal matrix and the parametric results of such weighting.

Three-dimensional relationships of the above-described parameters of backspin, penetration, trajectory and ballooning are illustrated in FIG. 13. It may be appreciated that ballooning control occurs primarily as a function of the X-axis, as does hook and slice compensation, while maximum backspin occurs as a function of weighting at the (Y1, Z1) position with minimum backspin occurring with weighting at the (Y3, Z3) position. Penetration is also a function of the combined effect of two axes, that is, maximum penetration occurring with weighting at the (Y3, Z3) position and minimum penetration occurring with weighting at the (Y1, Z1) coordinate.

Figure 14:
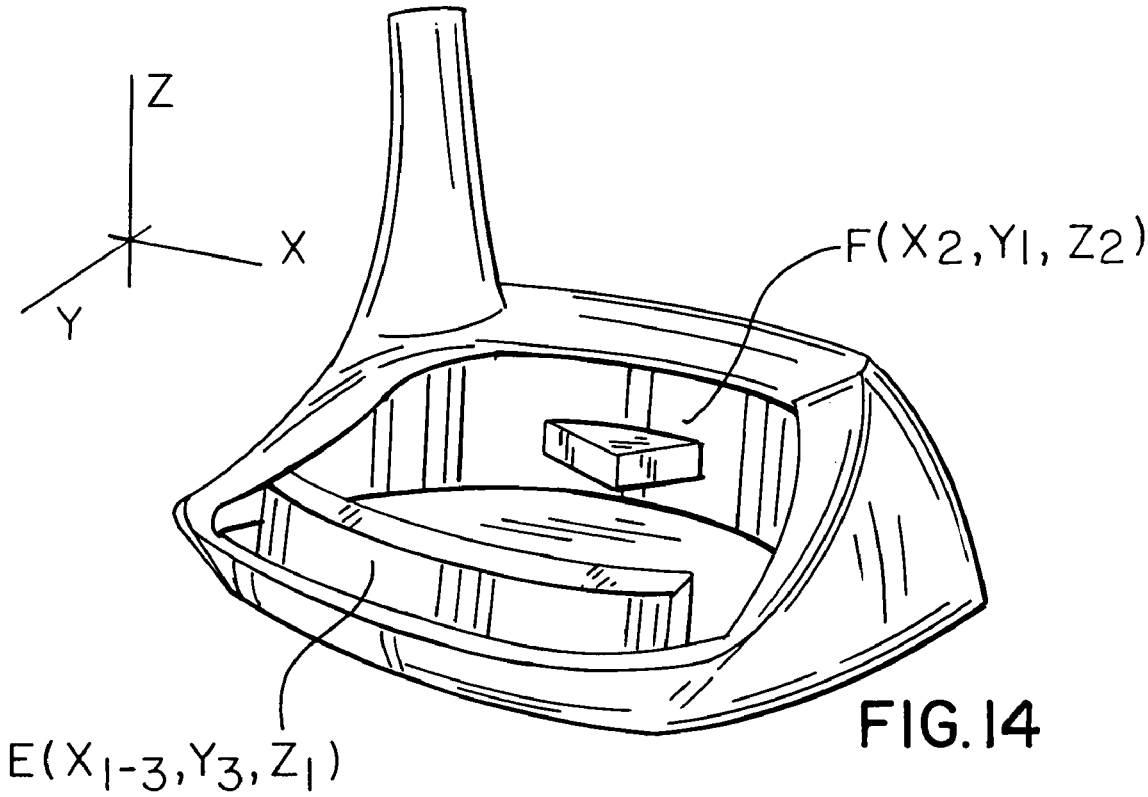
FIG. 14 is a view of a club head of the type of FIG. 1, however showing the use of multiple weights across multiple coordinates.

In FIG. 14 is shown the use of weights E and F in two different areas of the golf club 100 of FIG. 1. Therein, a good player would move weight E to the back of the club to achieve as penetrating a shot as he could, and would also position weight F to reduce the spin, putting an additional weight in the X-axis center (X2) of the club. This makes the sweet spot smaller, that is, the player must strike the ball right in the center (X2). That is, an ideal strike which would result in a best transference of energy. However, it causes a largest margin of error. Such a golfer therefore would have to be a rather good player to move to the center of the face where he wants to hit the ball. Said weight E also maximizes penetration.

Figure 15:
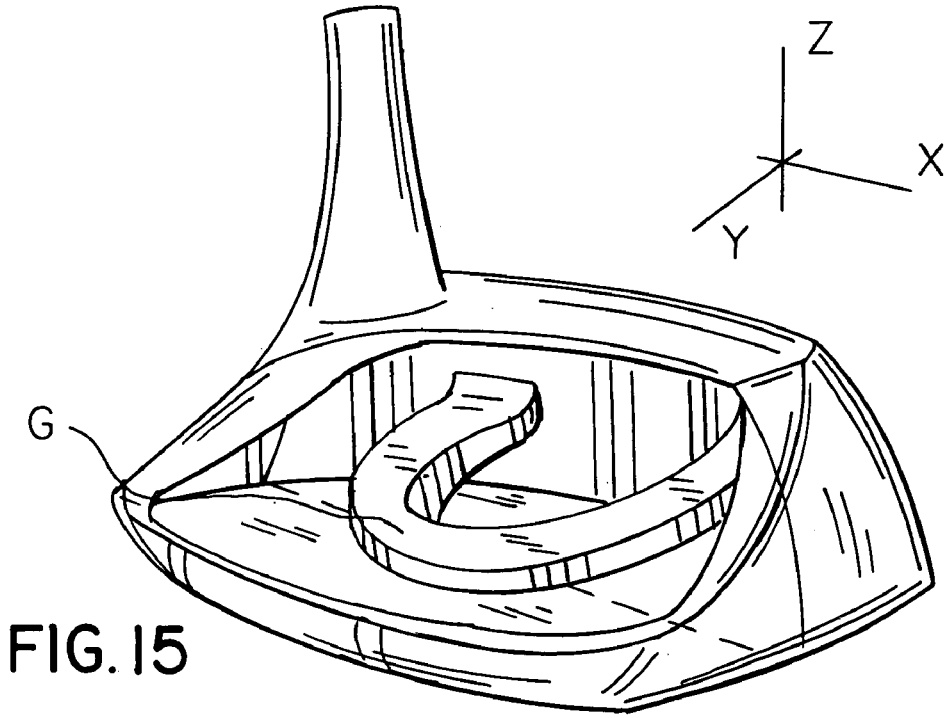
FIG. 15 is a view, the use of a horse shoe weighting element to broaden the sweet spot and to achieve other modifications of ball flight performance.

In FIG. 15 is shown the effect of a horse shoe-like structure G, symmetric about the YZ plane at the X2 position. This helps the basic or average player. Such a player moves the weight toward the heel and the toe 112 to make his sweet spot as wide as possible. Structure G also moves the weight down toward the back to get some height on the ball, and also to get more penetration to pick-up some distance. This would be a club for a basic, standard player who simply needs some help that is not interested in slice hook combination. It's just addressing trajectory and spin rate.

Figure 16:
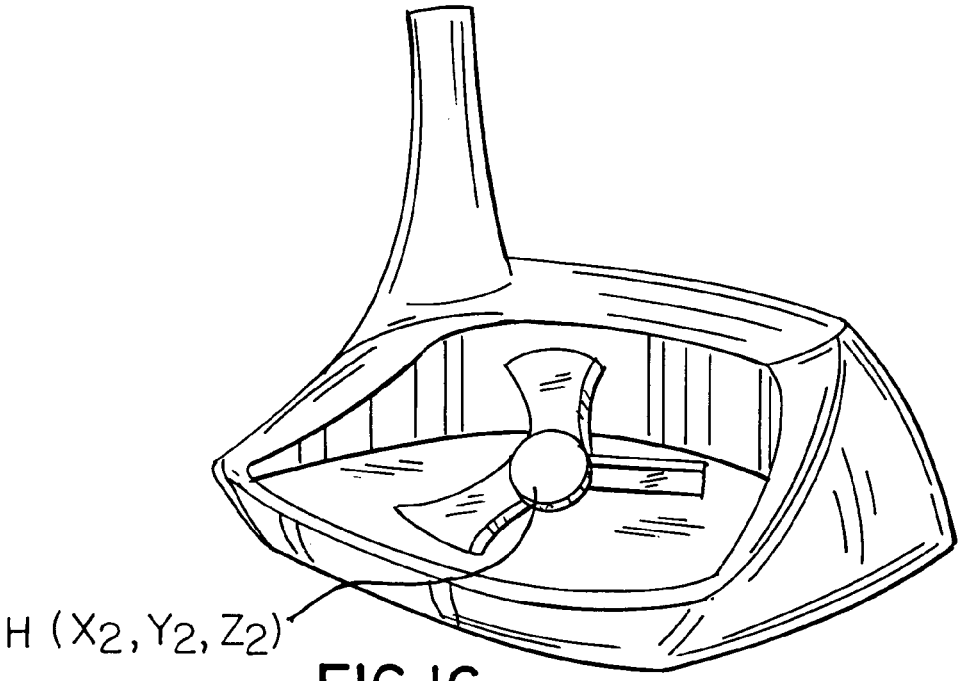
FIG. 16 is s a view showing the use of a propeller type weighting element to modify golf club performance.

With reference to FIG. 16, there is shown the use of a propeller type weight H, having its center at (X2, Y2, Z2), which would be used if one were hitting the ball a bit to the left and low. To compensate for that, the weight is moved to the left, so that the ball will move to the right. To counteract the moving the weight to the left, one may place a projection of the weight H down toward the right hand corner to get the ball up into the air again, and to also move another projection to the rear for penetration and movement up in the air.

Figure 17:
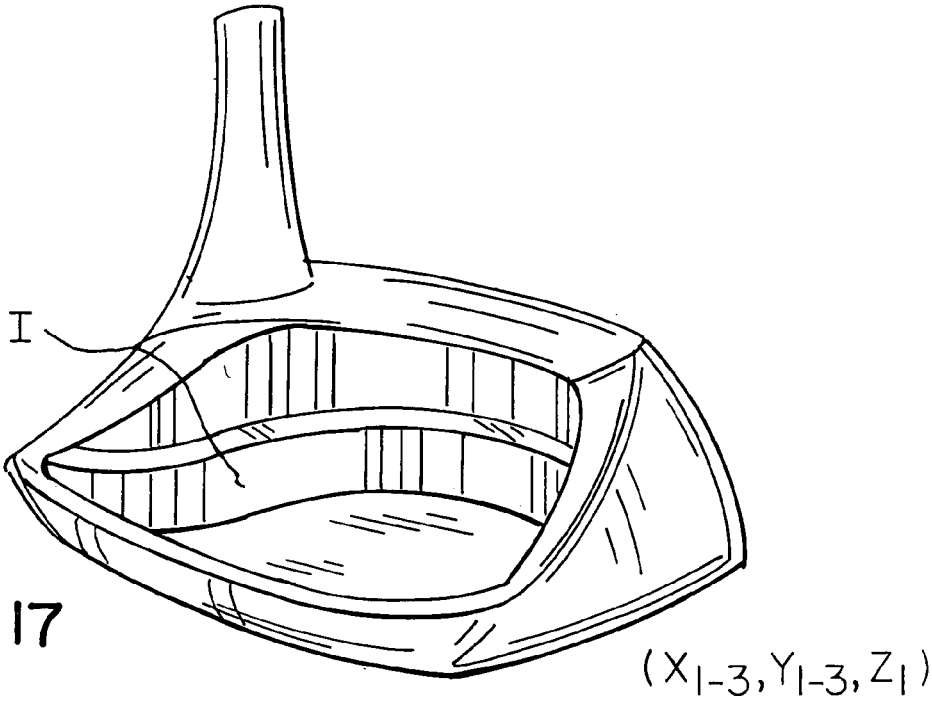
FIG. 17 is a view in which a strip-like element is used to modify club performance.

With reference to FIG. 17, there is shown the use of a saddle-like weighting element I inserted along the sides and behind the face plate. The benefits of such a weighting geometry are that the weight is set to hit the ball a little higher because the weight is low. It also tends to give it a bit more of penetration, because the weight is moved back. By also moving it to the left, one pushes the ball out to the right, tending to give a shot slightly to the right and is penetrating, but yet will have some spin on it. So it starts out low, goes right and then slows down.

The following charts relate to weighting coordinates to figures, by planes of the orthonormal matrix.

CHART 1

(xy plane)

| | X1 (heel) | X2 | X3(toe) |
|---|---|---|---|
| $Y_1$ | FIG. 9 | FIG. 7(B), 14(F) | FIG. 7(A), 8(D) |
| $Y_2$ | | FIG. 2, 6, 16 | |
| $Y_3$ | FIG. 11, 14(E) | FIGS. 8(C), 10, 14(E) | FIGS. 10, 14(E) |

CHART 2

(xz plane)

| | X1 (heel) | X2 | X3 (toe) |
|---|---|---|---|
| Z1 (heel) | | FIGS. 7(B), 10, 16 | |
| Z2 | FIG. 9, 11 | FIG. 2, 14(F) | FIGS. 7(A), 8(D) |
| Z3 | | FIGS. 6, 8(C) | FIG. 10 |

CHART 3

| | (yz plane) | | |
|---|---|---|---|
| | Y1 (toe) | Y2 | Y3 |
| Z1 | FIG. 7(B) | FIG. 16 | FIG. 10, 14(E) |
| Z2 | FIGS. 7(A), 8(D), 9 | FIG. 5 | FIG. 11 |
| Z3 | | FIG. 6 | FIG. 8(C), 12 |

Figure 18:
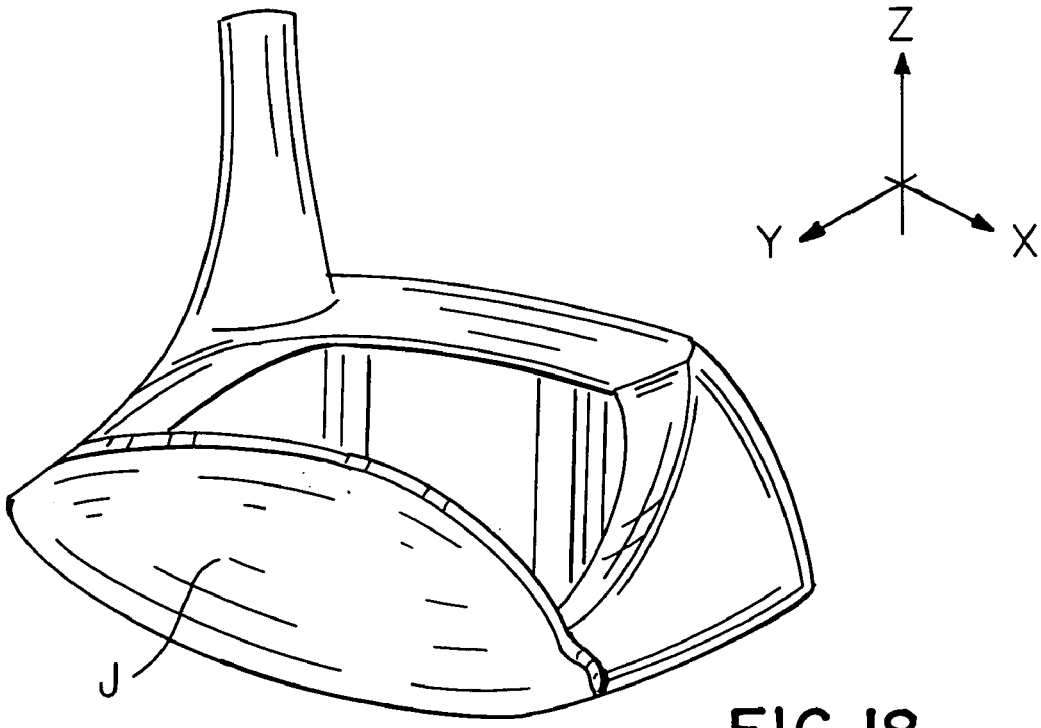
FIG. 18 illustrates the use of a clip-on element to achieve particular modifications of golf strike and ball flight characteristics.
Figure 19:
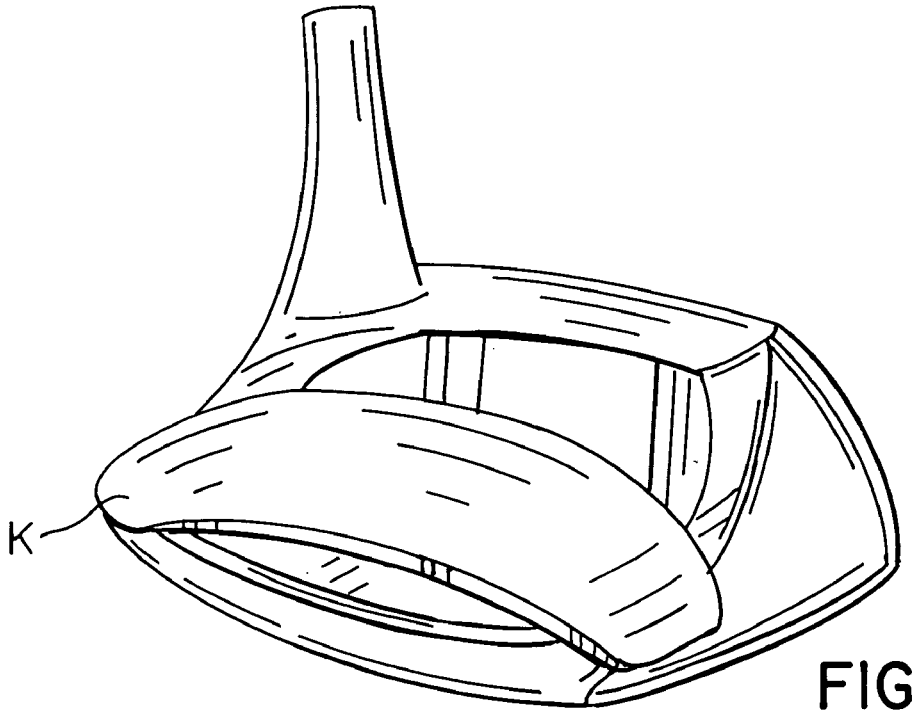
FIG. 19 shows a further snap-on element to provide different performance characteristics.
Figure 20:
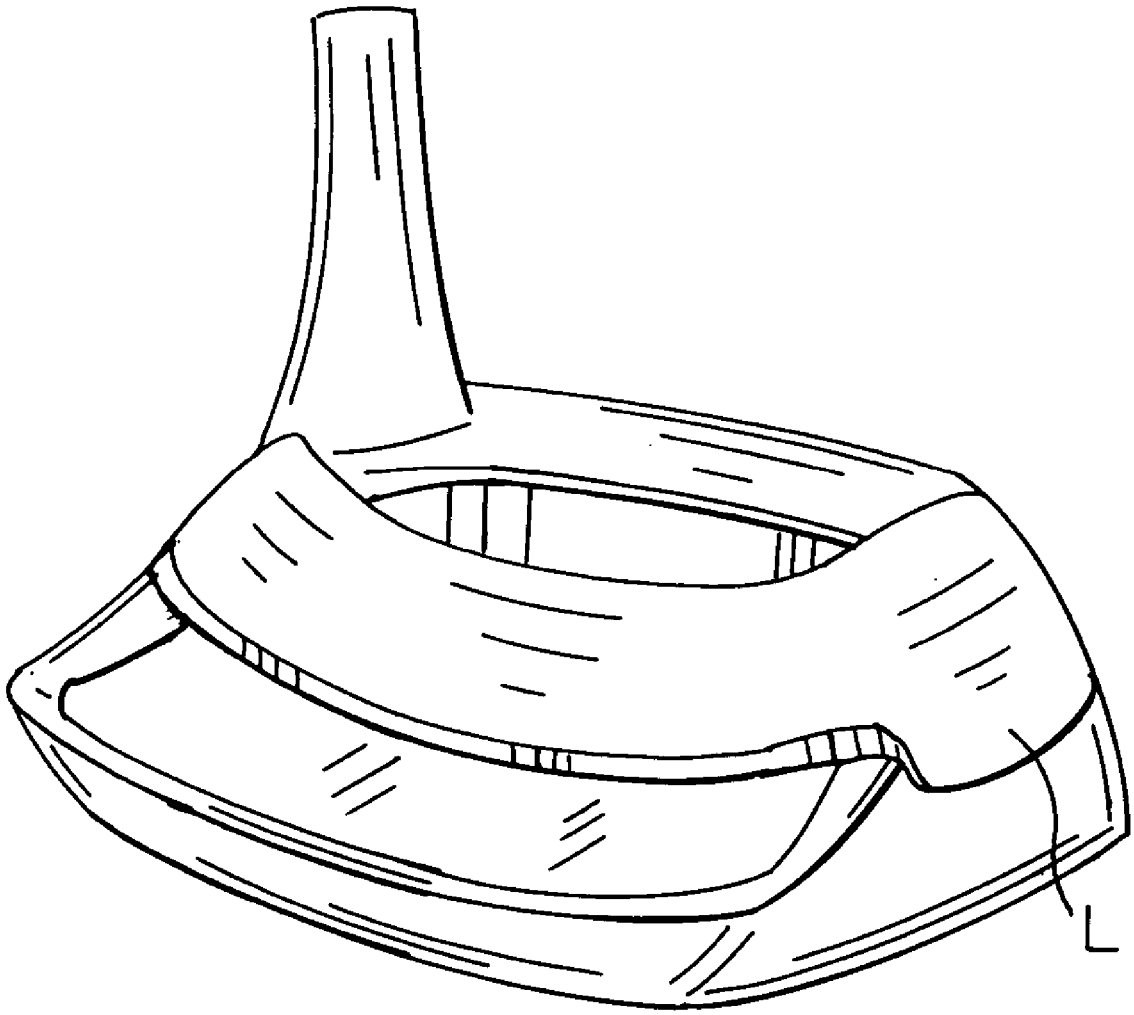
FIG. 20 shows a yet further snap-on weighting element for the modification of ball strike characteristics.

In FIGS. 18–20 are shown the use of clip-on type weighting elements. More particularly, a weighting element J of FIG. 18 moves weight to the rear of the club, thus increasing penetration, while lowering the enter of gravity of the club and increasing spin.

In a weighting element K of FIG. 19, weight is not moved back as far, and is raised-up slightly higher than that of element J. This reduces penetration with slightly reduced backspin, the result being a more controllable ball strike.

In FIG. 20, weighting element L provides an elevation of weight, thereby lowering trajectory which also widens the sweet spot, as in element G of FIG. 15. Also, if element L is asymmetric to the right of a YZ plane of symmetry thru location X2, slice compensation is also provided.

It is noted that many of the above functions of the weighting elements may be achieved thru variation in weight and dimension of sole plate 106 (see FIG. 1). For example, if a change in weight is indicated at a (X, Y, Z1) coordinate, a change in weight or weight-distribution in the sole plate will affect the parameters shown in the chart of FIG. 3. Also, as may be noted in FIG. 4, addition or reduction of weight at Z1 will affect trajectory and backspin.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention what I claim as new, useful and non-obvious and, accordingly, secure by Letters Patent of the United States is:

1. A method of enhancing performance of a golf club, the method comprising the steps of:

(a) providing a void space behind a face plate of said club and above a sole portion thereof;

(b) applying a virtual X, Y, Z orthonormal coordinate system to said club in which said sole portion is partially congruent with a bottom-most xy plane thereof, in which said face plate intersects a forward-most XZ plane thereof, and in which a heel and hosel side of said club intersects a YZ plane thereof substantially at an origin of said coordinate system, and further in which an increase in X-axis value corresponds to a direction of a toe of said club, an increase in Y-axis value corresponds in direction to a rear of said club, and an increase in Z-axis value corresponds to increase in height above said sole portion;

(c) selectably employing two of the following club weighting strategies to said club, in which at least one weighting means thereof is not contiguous to any part of said face plate and a selected value of Y in any one of said strategies does not equal a selected value of Y in a second selected strategy, the strategies comprising:

(i) to modify backspin, providing within said void space weighting means between a low Y, low Z coordinate to increase backspin to a high Y, high Z coordinate to decrease backspin;

(ii) to modify ball penetration, providing within said void space weighting means between a high Y, high Z coordinate to maximize penetration to a low Y, low Z coordinate to minimize penetration;

(iii) to modify ball trajectory, modifying weighting means substantially within said void space between a low Z-coordinate to increase trajectory to a high Z-coordinate to decrease trajectory; or (iv) to compensate for ball hook or slice, providing weighting means substantially within said void space at a low X-coordinate to compensate for hook to a high X-coordinate to compensate for slice, thereby enhancing performance of said club.

2. The method as recited in claim 1, in which said selectable club weighting strategies further include the step of:

(v) providing weighting means within said void space at a high Y, high Z coordinate to minimize said ballooning or at a low Y, low Z coordinate to maximize said ballooning.

3. The method as recited in claim 1, in which said weighting means comprises golfer-replaceable elements.

4. The method as recited in claim 2, in which said weighting means comprises golfer-replaceable elements.

5. The method as recited in claim 1, in which said weighting means comprises a weight which is non-uniform along one or more of said X, Y and Z axes.

6. The method as recited in claim 5, in which said weighting means comprises golfer-replaceable elements.

7. The method as recited in claim 5, including:

selection of Step(c)(ii) by securing a strip-like weighting element over said void space at about a (Y2–Y3, Z2) position and spanning all X positions, thereby providing modification of penetration at a medium ball trajectory; and selection of Step (c)(iv) with regard to the x-axis to compensate for hock or slice.

8. The method of enhancing performance of a golf club as recited in claim 1, in which:

said selectably employing two club weighting strategies further comprising employing three of said strategies.

9. The method of enhancing performance of a golf club as recited in claim 1, in which at least one selected strategy includes weighting means not contiguous with any inner surface of said void space.

10. The method as recited in claim 1, in which a weighting means of a first selected strategy may be integral with that of a second selected strategy.

11. A method of enhancing performance of a golf club, the method comprising the steps of:

(a) providing a void space behind a face plate of said club and above a sole portion thereof;

(b) applying a virtual X, Y, Z orthonormal coordinate system to said club in which said sole portion is partially congruent with a bottom-most xy plane thereof, in which said face plate intersects a forward-most XZ plane thereof, and in which a heel and hosel side of said club intersects a YZ plane thereof substantially at an origin of said coordinate system, and further in which an increase in X-axis value corresponds to a direction of a toe of said club, an increase in Y-axis value corresponds in direction to a rear of said club, and an increase in Z-axis value corresponds to increase in height above said sole portion;

(c) providing weighting means substantially within said void space between a high Y, high Z coordinate to minimize ballooning to a low Y, low Z coordinate to maximize said ballooning; and (d) providing weighting means substantially within said void space between a low X-coordinate to compensate for hook to a high X-coordinate to compensate for slice.

12. The method as recited in claim 11, further comprising the step of:

(e) selectably employing at least one of the following club weighting strategies to said club, in which a selected value of X, Y or Z does not include the value of Y used in Step (c):

(i) to modify backspin, providing within said void space, weighting means between a low Y, low Z coordinate to increase backspin to a high Y, high Z coordinate to decrease backspin; or (ii) to modify ball penetration, providing within said void space weighting means at a high Y, high Z coordinate to maximize penetration or at a low Y, low Z coordinate to minimize penetration; or (iii) to modify ball trajectory, providing weighting means substantially within said void space between a low Z-coordinate to increase trajectory to a high Z-coordinate to decrease trajectory.

13. The method as recited in claim 12, in which any selected value of Y of Step (e) is not contiguous with any part of said face plate.

14. The method as recited in claim 12, in which said weighting means of at least one strategy is non-uniform along one or more of said X, Y and Z axes.

15. The method as recited in claim 14, including:

selection of Step (e)(ii) by securing a strip-like weighting element over said void space at about a (Y2–Y3, Z2) position and spanning all X positions, thereby providing modification of penetration to medium ball trajectory; and selection of Step (d) with regard to the X-axis to compensate for hook or slice.

16. The method as recited in claim 11, in which said weighting means comprises golfer-replaceable elements.

17. The method as recited in claim 11, in which said weighting means of at least one strategy is non-uniform along one or more of said X, Y and Z axes.

18. The method as recited in claim 17, in which said weighting means comprises golfer-replaceable elements.

19. The method as recited in claim 11, in which in which a weighting means of a first selected strategy may be integral with that of a second selected strategy.

* * * * *

UNITED STATES PATENT AND TRADEMARK OFFICE

CERTIFICATE OF CORRECTION

PATENT NO. : 7,128,660 B2
APPLICATION NO. : 10/818899
DATED : October 31, 2006
INVENTOR(S) : John P. Gillig It is certified that error appears in the above-identified patent and that said Letters Patent is hereby corrected as shown below:

On Title Page item (73) Assignee, change

"(73) Assignee: Elizabeth P. Gillig Revocable Trust, Duxbury, MA (US)"

to

--(73) Assignee: Triple Tee Golf, Inc., Pompano Beach, FL (US)--

Signed and Sealed this

Thirty-first Day of July, 2007

JON W. DUDAS
*Director of the United States Patent and Trademark Office*

US007128660C1

(12) INTER PARTES REEXAMINATION CERTIFICATE (712th)

United States Patent

Gillig

(10) Number: US 7,128,660 C1

(45) Certificate Issued: Oct. 24, 2013

(54) METHOD OF GOLF CLUB PERFORMANCE ENHANCEMENT AND ARTICLES RESULTANT THEREFROM

(75) Inventor: John P. Gillig, Pompano Beach, FL (US)

(73) Assignee: Triple Tee Golf, Inc., Pompano Beach, FL (US)

Reexamination Request:
No. 95/002,049, Jul. 20, 2012

Reexamination Certificate for:

| | |
|---|---|
| Patent No.: | **7,128,660** |
| Issued: | **Oct. 31, 2006** |
| Appl. No.: | **10/818,899** |
| Filed: | **Apr. 3, 2004** |

Certificate of Correction issued Jul. 31, 2007

Related U.S. Application Data

(63) Continuation-in-part of application No. 10/383,532, filed on Mar. 10, 2003, now abandoned, which is a continuation-in-part of application No. 09/849,522, filed on May 7, 2001, now Pat. No. 6,530,848.

(60) Provisional application No. 60/205,250, filed on May 19, 2000.

(51) Int. Cl.
*A63B 53/00* (2006.01)
*A63B 53/04* (2006.01)

(52) U.S. Cl.
USPC ..... 473/324; 473/409; 473/334; 473/340; 473/345

(58) Field of Classification Search
USPC ..... 473/324, 409, 334, 340, 345
See application file for complete search history.

(56) References Cited

To view the complete listing of prior art documents cited during the proceeding for Reexamination Control Number 95/002,049, please refer to the USPTO's public Patent Application Information Retrieval (PAIR) system under the Display References tab.

*Primary Examiner* — Matthew C. Graham

(57) ABSTRACT

The performance of a golf club may be enhanced through the provision of a void space behind a face plate and above the sole plate, to decrease club weight and provide single or combinations of selectable weighting elements within volumetric coordinates of an orthonormal matrix about the void space. The weighting coordinates are provided in response to ball strike, flight analysis and physiologic observation of the golf strike swing. Ball backspin, trajectory, penetration and hook or slice may be modified through the use of a definable weighting strategy.

At the time of issuance and publication of this certificate, the patent remains subject to pending reexamination control number 90/012,788 filed Feb. 6, 2013. The claim content of the patent may be subsequently revised if a reexamination certificate issues from the reexamination proceeding.

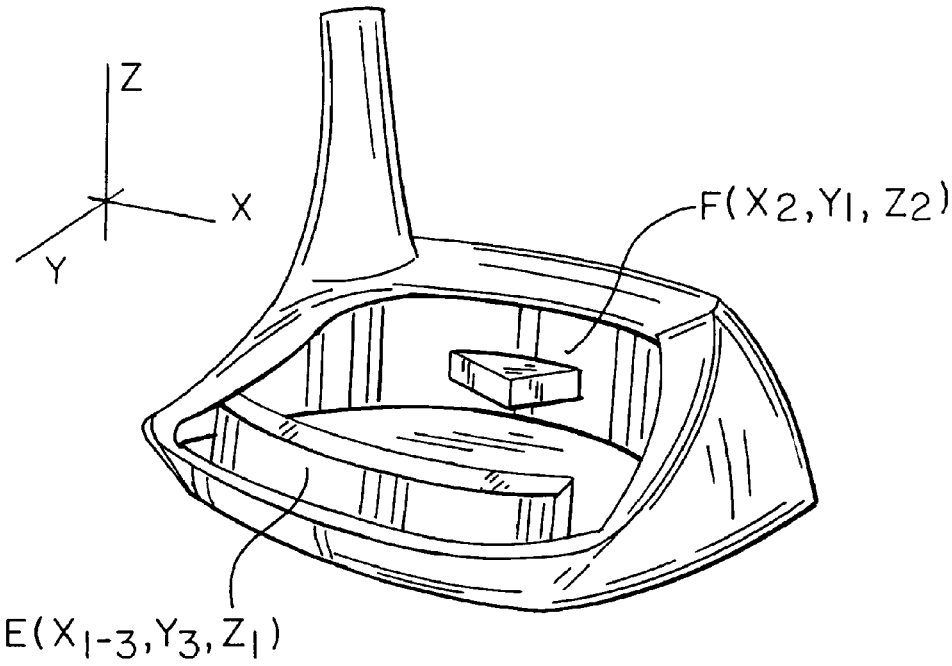

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, line 11:

It is a further object to provide a club head, modified with a hollow interior and having selectable point, axis, vector *and* distributed linear or non-linear weights which may be inserted or removed to suit particular preferences, needs and physiologic requirements of a golfer.

AS A RESULT OF REEXAMINATION, IT HAS BEEN DETERMINED THAT:

Claims 1-6, 8, 10-14 and 16-19 are cancelled.

Claims 7, 9 and 15 were not reexamined.

* * * * *

US007128660C2

(12) EX PARTE REEXAMINATION CERTIFICATE (10189th)

United States Patent

Gillig

(10) Number: US 7,128,660 C2

(45) Certificate Issued: Jun. 12, 2014

(54) METHOD OF GOLF CLUB PERFORMANCE ENHANCEMENT AND ARTICLES RESULTANT THEREFROM

(75) Inventor: John P. Gillig, Pompano Beach, FL (US)

(73) Assignee: Triple Tee Golf, Inc., Pompano Beach, FL (US)

Reexamination Request:
No. 90/012,788, Feb. 6, 2013

Reexamination Certificate for:

| | |
|---|---|
| Patent No.: | **7,128,660** |
| Issued: | **Oct. 31, 2006** |
| Appl. No.: | **10/818,899** |
| Filed: | **Apr. 3, 2004** |

Reexamination Certificate C1 7,128,660 issued Oct. 24, 2013

Certificate of Correction issued Jul. 31, 2007

Related U.S. Application Data

(63) Continuation-in-part of application No. 10/383,532, filed on Mar. 10, 2003, now abandoned, which is a continuation-in-part of application No. 09/849,522, filed on May 7, 2001, now Pat. No. 6,530,848.

(60) Provisional application No. 60/205,250, filed on May 19, 2000.

(51) Int. Cl.
*A63B 53/00* (2006.01)
*A63B 53/04* (2006.01)

(52) U.S. Cl.
USPC ..... 473/324; 473/334; 473/340; 473/345; 473/409

(58) Field of Classification Search
USPC ..... 473/335, 345, 349
See application file for complete search history.

(56) References Cited

To view the complete listing of prior art documents cited during the proceeding for Reexamination Control Number 90/012,788, please refer to the USPTO's public Patent Application Information Retrieval (PAIR) system under the Display References tab.

*Primary Examiner* — Matthew C. Graham

(57) ABSTRACT

The performance of a golf club may be enhanced through the provision of a void space behind a face plate and above the sole plate, to decrease club weight and provide single or combinations of selectable weighting elements within volumetric coordinates of an orthonormal matrix about the void space. The weighting coordinates are provided in response to ball strike, flight analysis and physiologic observation of the golf strike swing. Ball backspin, trajectory, penetration and hook or slice may be modified through the use of a definable weighting strategy.

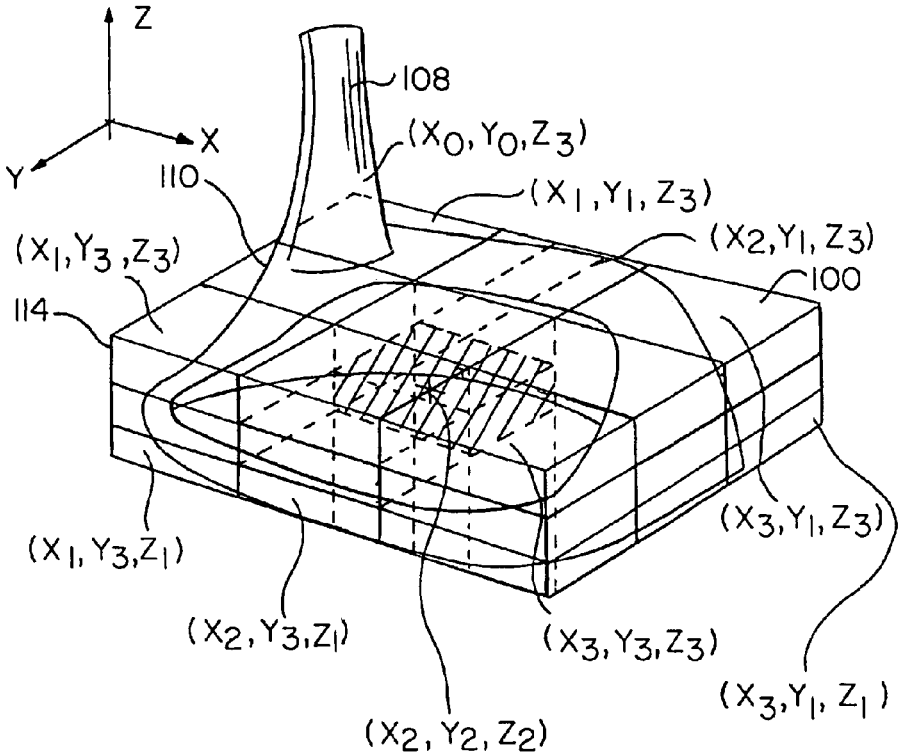

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-6, 8, 10-14 and 16-19 were previously cancelled.

Claims 9 and 15 are cancelled.

Claim 7 is determined to be patentable as amended.

New claims 20-22 are added and determined to be patentable.

7. The method as recited in claim [5] *20*, including:

*a* selection [of Step(c)(ii)] by securing a strip-like weighting element over said void space at about a (Y2-Y3, Z2) position and spanning all X positions, thereby providing modification of penetration at a medium ball trajectory; and

*weighting* selection [of Step (c)(iv)] with regard to the X-axis to compensate for [hock] *hook* or slice.

*20. A method of enhancing performance of a golf club head, the method comprising the steps of:*

*(a) providing a void space behind a face plate of the golf club head and above a sole portion thereof;*

*(b) applying a virtual X, Y, Z orthonormal coordinate system including X1, X2 and X3 respective low-to-high locations upon an X-axis of said system, Y1, Y2, and Y3 respective low-to-high locations upon a Y-axis of said system, and Z1, Z2 and Z3 respective low-to-high locations of said system upon a Z-axis of said system within said head to define a 3×3×3 volumetric matrix of cells in which said sole portion is partially congruent with a bottom-most XY plane thereof, in which said face plate intersects a forward-most XZ plane thereof, and in which a heel and hosel side of said head intersects a YZ plane thereof substantially at an origin of said coordinate system, and further in which an increase in X-axis value corresponds to a direction from a heel-to-toe of said head, an increase in Y-axis value corresponds in direction from a face-to-rear of said head, and an increase in Z-axis value corresponds to an increase in height above said sole portion; and*

*(c) selectably employing two of the following weighting strategies to said club head, in which at least one weighting means thereof is not contiguous to any part of said face plate and a selected value of Y in one of said strategies does not equal a selected value of Y in a second selected strategy, the strategies comprising:*

*(i) to modify backspin, providing within said void space weighting means between a low Y, low Z coordinate to increase backspin to a high Y, high Z coordinate to decrease backspin in which an increase in a Z-axis value does not correspond to a decrease in Y-axis value;*

*(ii) to modify ball penetration, providing within said void space weighting means between a high Y, high Z coordinate to maximize penetration to a low Y, low Z coordinate to minimize penetration;*

*(iii) to modify ball trajectory, modifying weighting means substantially within said void space between a low Z-coordinate to increase trajectory to a high Z-coordinate to decrease trajectory: or*

*(iv) to compensate for ball hook or slice, providing weighting means substantially within said void space at a low X-coordinate to compensate for hook to a high X-coordinate to compensate for slice,*

*in which at least one selected strategy includes weighting means not contiguous with any inner surface of said void space.*

*21. The method as recited in claim 20, further comprising: positioning weighting means within said matrix of said void space between a low X or X1 coordinate to compensate for hook, to an high X or X3 coordinate to compensate for slice, said strategy selectably inclusive of a neutral hook-slice effect by positioning at a X2 coordinate.*

*22. The method as recited in claim 20, further comprising: positioning weighting means within said matrix of said void space between a low Z or Z1 coordinate, corresponding to increased trajectory, to a high Z or Z3 coordinate corresponding to decreased trajectory, said strategy selectably inclusive of a neutral effect Z2 coordinate therebetween.*

* * * * *